US006601658B1

(12) United States Patent
Downton

(10) Patent No.: US 6,601,658 B1
(45) Date of Patent: Aug. 5, 2003

(54) CONTROL METHOD FOR USE WITH A STEERABLE DRILLING SYSTEM

(75) Inventor: Geoff Downton, Minchinhampton (GB)

(73) Assignee: Schlumberger WCP LTD (GB)

( * ) Notice: Subject to any disclaimer, the term of this patent is extended or adjusted under 35 U.S.C. 154(b) by 53 days.

(21) Appl. No.: 09/869,686

(22) PCT Filed: Nov. 10, 2000

(86) PCT No.: PCT/GB00/04291

§ 371 (c)(1),
(2), (4) Date: Oct. 9, 2001

(87) PCT Pub. No.: WO01/34935

PCT Pub. Date: May 17, 2001

Related U.S. Application Data

(60) Provisional application No. 60/164,681, filed on Nov. 10, 1999.

(51) Int. Cl.[7] ..... E21B 7/04
(52) U.S. Cl. ..... 175/45; 73/152.45; 702/9
(58) Field of Search ..... 175/40, 45, 48, 175/50, 61; 702/9; 73/152.03, 152.43, 152.44, 152.45, 152.46

(56) References Cited

U.S. PATENT DOCUMENTS

| | | | |
|---|---|---|---|
| 712,887 | A | 11/1902 | Wyczynski |
| 1,971,480 | A | 8/1934 | Earley |
| 2,319,236 | A | 5/1943 | Isaacks |
| 2,345,766 | A | 4/1944 | Miller |
| 2,585,207 | A | 2/1952 | Zublin |
| 2,687,282 | A | 8/1954 | Sanders |
| 2,694,549 | A | 11/1954 | James |
| 2,712,434 | A | 7/1955 | Giles et al. |
| 2,857,141 | A | 10/1958 | Carpenter |
| 2,876,992 | A | 3/1959 | Lindsay |
| 3,051,255 | A | 8/1962 | Deely |
| 3,062,303 | A | 11/1962 | Schultz |
| 3,068,946 | A | 12/1962 | Frisby et al. |
| 3,092,188 | A | 6/1963 | Farris |
| 3,098,534 | A | 7/1963 | Carr et al. |
| 3,104,726 | A | 9/1963 | Davis |
| 3,123,162 | A | 3/1964 | Rowley |
| 3,129,776 | A | 4/1964 | Mann |
| 3,225,843 | A | 12/1965 | Ortloff et al. |
| 3,305,771 | A | 2/1967 | Arps |

(List continued on next page.)

FOREIGN PATENT DOCUMENTS

| | | |
|---|---|---|
| EP | 0 343 800 A2 | 11/1989 |
| EP | 0 594 418 A1 | 4/1994 |
| EP | 0 685 623 A2 | 12/1995 |
| EP | 0 459 008 B1 | 5/1996 |
| EP | 0 520 733 B1 | 6/1996 |
| EP | 0 744 526 A1 | 11/1996 |
| EP | 0 762 606 A2 | 3/1997 |
| EP | 0 530 045 B1 | 4/1997 |
| EP | 0 770 760 A1 | 5/1997 |
| EP | 0 841 462 A2 | 5/1998 |
| EP | 0 874 128 A2 | 10/1998 |
| EP | 0 677 640 B1 | 9/1999 |
| EP | 0 685 626 B1 | 8/2000 |
| EP | 0 728 907 B1 | 8/2000 |
| EP | 0 728 908 B1 | 8/2000 |
| EP | 0 728 909 B1 | 8/2000 |
| EP | 0 728 910 B1 | 8/2000 |
| GB | 2 154 485 A | 9/1985 |
| GB | 2 172 324 A | 9/1986 |
| GB | 2 172 325 A | 9/1986 |

(List continued on next page.)

*Primary Examiner*—David Bagnell
*Assistant Examiner*—Matthew J Smith
(74) *Attorney, Agent, or Firm*—Jeffery E. Daly

(57) ABSTRACT

A control method for use with a steerable drilling system comprises the steps of inputting parametric model data representative of drilling conditions and using the data to determine achievable drilling directions.

11 Claims, 4 Drawing Sheets

U.S. PATENT DOCUMENTS

Figure 1:
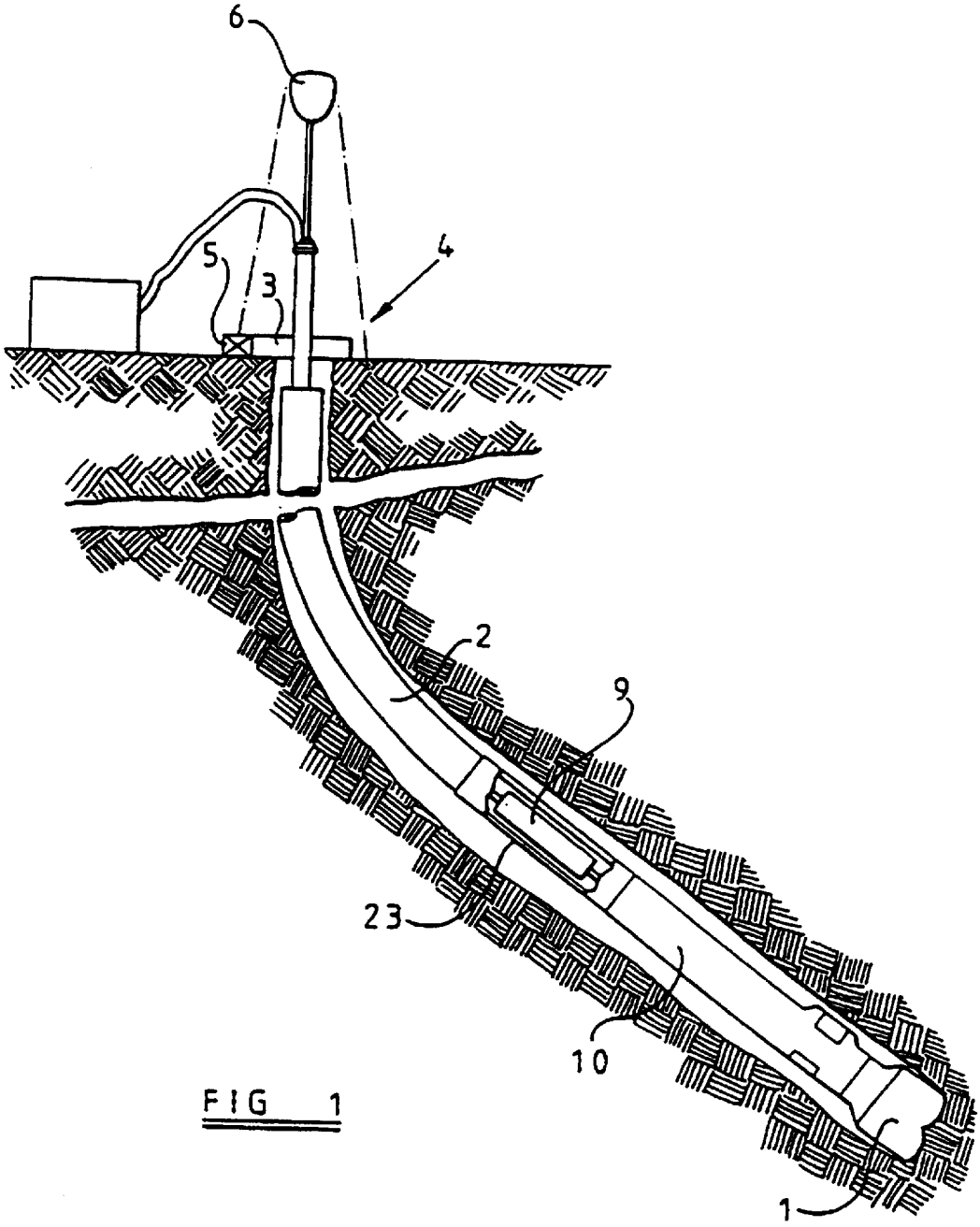

| | | | | | |
|---|---|---|---|---|---|
| 3,309,656 | A | | 3/1967 | Godbey | |
| 3,370,657 | A | | 2/1968 | Antie | |
| 3,457,999 | A | | 7/1969 | Massey | |
| 3,512,592 | A | | 5/1970 | Kellner | |
| 3,561,549 | A | | 2/1971 | Garrison et al. | |
| 3,575,247 | A | | 4/1971 | Feenstra | |
| 3,637,032 | A | | 1/1972 | Jeter | |
| 3,667,556 | A | | 6/1972 | Henderson | |
| 3,743,034 | A | | 7/1973 | Bradley | |
| 3,799,279 | A | | 3/1974 | Farris | |
| 3,878,903 | A | | 4/1975 | Cherrington | |
| 3,888,319 | A | | 6/1975 | Bourne, Jr. et al. | |
| 3,903,974 | A | | 9/1975 | Cullen | |
| 3,974,886 | A | | 8/1976 | Blake, Jr. | |
| 3,993,127 | A | * | 11/1976 | Chepelev et al. | 175/61 |
| 3,997,008 | A | | 12/1976 | Kellner | |
| 4,022,287 | A | | 5/1977 | Lundstrom et al. | |
| 4,027,301 | A | | 5/1977 | Mayer | |
| 4,040,494 | A | | 8/1977 | Kellner | |
| 4,040,495 | A | | 8/1977 | Kellner et al. | |
| 4,076,084 | A | | 2/1978 | Tighe | |
| 4,080,115 | A | | 3/1978 | Sims et al. | |
| 4,152,545 | A | | 5/1979 | Gilbreath, Jr. et al. | |
| 4,184,553 | A | | 1/1980 | Jones, Jr. et al. | |
| 4,185,704 | A | | 1/1980 | Nixon, Jr. | |
| 4,190,123 | A | | 2/1980 | Roddy | |
| 4,211,292 | A | | 7/1980 | Evans | |
| 4,220,513 | A | | 9/1980 | Green et al. | |
| 4,241,796 | A | | 12/1980 | Green et al. | |
| 4,263,552 | A | * | 4/1981 | Weber | 324/326 |
| 4,270,619 | A | | 6/1981 | Base | |
| 4,291,773 | A | | 9/1981 | Evans | |
| 4,305,474 | A | | 12/1981 | Farris et al. | |
| 4,351,037 | A | | 9/1982 | Scherbatskoy | |
| 4,357,634 | A | | 11/1982 | Chung | |
| 4,388,974 | A | | 6/1983 | Jones, Jr. et al. | |
| 4,394,881 | A | | 7/1983 | Shirley | |
| 4,407,377 | A | | 10/1983 | Russell | |
| 4,416,339 | A | | 11/1983 | Baker et al. | |
| 4,428,441 | A | | 1/1984 | Dellinger | |
| 4,449,595 | A | | 5/1984 | Holbert | |
| 4,456,080 | A | | 6/1984 | Holbert | |
| 4,461,359 | A | | 7/1984 | Jones, Jr. et al. | |
| 4,465,147 | A | | 8/1984 | Feenstra | |
| 4,491,187 | A | | 1/1985 | Russell | |
| 4,492,276 | A | | 1/1985 | Kamp | |
| 4,515,225 | A | | 5/1985 | Dailey | |
| 4,523,652 | A | | 6/1985 | Schuh | |
| 4,560,013 | A | | 12/1985 | Beimgraben | |
| 4,572,305 | A | | 2/1986 | Swietlik | |
| 4,577,701 | A | | 3/1986 | Dellinger et al. | |
| 4,635,736 | A | | 1/1987 | Shirley | |
| 4,637,479 | A | | 1/1987 | Leising | |
| 4,638,873 | A | | 1/1987 | Welborn | |
| 4,655,289 | A | | 4/1987 | Schoeffler | |
| 4,662,458 | A | | 5/1987 | Ho | |
| 4,667,751 | A | | 5/1987 | Geczy et al. | |
| 4,683,956 | A | | 8/1987 | Russell | |
| 4,690,229 | A | | 9/1987 | Raney | |
| 4,697,651 | A | | 10/1987 | Dellinger | |
| 4,699,224 | A | | 10/1987 | Burton | |
| 4,714,118 | A | | 12/1987 | Baker et al. | |
| 4,732,223 | A | | 3/1988 | Schoeffler et al. | |
| 4,739,843 | A | | 4/1988 | Burton | |
| 4,763,258 | A | | 8/1988 | Engelder | |
| 4,787,093 | A | | 11/1988 | Rorden | |
| 4,794,534 | A | * | 12/1988 | Millheim | 702/9 |
| 4,804,051 | A | * | 2/1989 | Ho | 175/45 |
| 4,807,708 | A | | 2/1989 | Forrest et al. | |
| 4,811,798 | A | | 3/1989 | Falgout, Sr. et al. | |
| 4,821,815 | A | | 4/1989 | Baker et al. | |
| 4,821,817 | A | | 4/1989 | Cendre et al. | |
| 4,836,301 | A | | 6/1989 | Van Dongen et al. | |
| 4,842,083 | A | | 6/1989 | Raney | |
| 4,844,178 | A | | 7/1989 | Cendre et al. | |
| 4,848,488 | A | | 7/1989 | Cendre et al. | |
| 4,848,490 | A | | 7/1989 | Anderson | |
| 4,854,397 | A | | 8/1989 | Warren et al. | |
| 4,854,403 | A | | 8/1989 | Ostertag et al. | |
| 4,858,705 | A | | 8/1989 | Thiery | |
| 4,867,255 | A | | 9/1989 | Baker et al. | |
| 4,880,067 | A | | 11/1989 | Jelsma | |
| 4,886,130 | A | | 12/1989 | Evans | |
| 4,895,214 | A | | 1/1990 | Schoeffler | |
| 4,901,804 | A | | 2/1990 | Thometz et al. | |
| 4,905,774 | A | | 3/1990 | Wittrisch | |
| 4,908,804 | A | | 3/1990 | Rorden | |
| 4,938,298 | A | | 7/1990 | Rehm | |
| 4,947,944 | A | | 8/1990 | Coltman et al. | |
| 4,948,925 | A | | 8/1990 | Winters et al. | |
| 4,951,760 | A | | 8/1990 | Cendre et al. | |
| 4,957,172 | A | * | 9/1990 | Patton et al. | 175/61 |
| 4,995,465 | A | | 2/1991 | Beck et al. | |
| 5,000,272 | A | | 3/1991 | Wiebe et al. | |
| 5,038,872 | A | | 8/1991 | Shirley | |
| 5,050,692 | A | | 9/1991 | Beimgraben | |
| 5,052,501 | A | | 10/1991 | Wenzel et al. | |
| RE33,751 | E | | 11/1991 | Geczy et al. | |
| 5,065,825 | A | | 11/1991 | Bardin et al. | |
| 5,070,950 | A | | 12/1991 | Cendre et al. | |
| 5,099,934 | A | | 3/1992 | Barr | |
| 5,103,919 | A | | 4/1992 | Warren et al. | |
| 5,109,935 | A | | 5/1992 | Hawke | |
| 5,113,953 | A | | 5/1992 | Noble | |
| 5,117,927 | A | | 6/1992 | Askew | |
| 5,131,479 | A | | 7/1992 | Boulet et al. | |
| 5,139,094 | A | | 8/1992 | Prevedel et al. | |
| 5,160,925 | A | | 11/1992 | Dailey et al. | |
| 5,163,521 | A | | 11/1992 | Pustanyk et al. | |
| 5,181,576 | A | | 1/1993 | Askew et al. | |
| 5,186,264 | A | | 2/1993 | du Chaffaut | |
| 5,213,168 | A | | 5/1993 | Warren et al. | |
| 5,220,963 | A | | 6/1993 | Patton | |
| 5,224,558 | A | | 7/1993 | Lee | |
| 5,251,708 | A | * | 10/1993 | Perry et al. | 175/41 |
| 5,265,682 | A | | 11/1993 | Russell et al. | |
| 5,265,687 | A | | 11/1993 | Gray | |
| 5,305,830 | A | | 4/1994 | Wittrisch | |
| 5,305,838 | A | | 4/1994 | Pauc | |
| 5,311,952 | A | | 5/1994 | Eddison et al. | |
| 5,311,953 | A | | 5/1994 | Walker | |
| 5,316,093 | A | | 5/1994 | Morin et al. | |
| 5,325,714 | A | | 7/1994 | Lende et al. | |
| 5,332,048 | A | | 7/1994 | Underwood et al. | |
| 5,341,886 | A | | 8/1994 | Patton | |
| 5,343,966 | A | | 9/1994 | Wenzel et al. | |
| 5,375,098 | A | | 12/1994 | Malone et al. | |
| 5,390,748 | A | | 2/1995 | Goldman | |
| 5,410,303 | A | | 4/1995 | Comeau et al. | |
| 5,421,420 | A | | 6/1995 | Malone et al. | |
| 5,467,834 | A | | 11/1995 | Hughes et al. | |
| 5,484,029 | A | | 1/1996 | Eddison | |
| 5,507,353 | A | | 4/1996 | Pavone | |
| 5,520,255 | A | | 5/1996 | Barr et al. | |
| 5,520,256 | A | | 5/1996 | Eddison | |
| 5,529,133 | A | | 6/1996 | Eddison | |
| 5,553,678 | A | | 9/1996 | Barr et al. | |
| 5,553,679 | A | | 9/1996 | Thorp | |
| 5,582,259 | A | | 12/1996 | Barr | |
| 5,594,343 | A | | 1/1997 | Clark et al. | |
| 5,602,541 | A | | 2/1997 | Comeau et al. | |

| | | | | | |
|---|---|---|---|---|---|
| 5,603,385 | A | | 2/1997 | Colebrook | |
| 5,617,926 | A | | 4/1997 | Eddison et al. | |
| 5,673,763 | A | | 10/1997 | Thorp | |
| 5,679,894 | A | * | 10/1997 | Kruger et al. | 73/152.03 |
| 5,685,379 | A | | 11/1997 | Barr et al. | |
| 5,695,015 | A | | 12/1997 | Barr et al. | |
| 5,706,905 | A | | 1/1998 | Barr | |
| 5,738,178 | A | | 4/1998 | Williams et al. | |
| 5,778,992 | A | | 7/1998 | Fuller | |
| 5,803,185 | A | | 9/1998 | Barr et al. | |
| 5,812,068 | A | | 9/1998 | Wisler et al. | |
| 5,842,149 | A | | 11/1998 | Harrell et al. | |
| 5,875,859 | A | | 3/1999 | Ikeda et al. | |
| 5,959,380 | A | | 9/1999 | Gillett et al. | |
| 5,971,085 | A | | 10/1999 | Colebrook | |
| 6,082,470 | A | | 7/2000 | Webb et al. | |
| 6,089,332 | A | | 7/2000 | Barr et al. | |
| 6,092,610 | A | | 7/2000 | Kosmala et al. | |
| 6,109,372 | A | | 8/2000 | Dorel et al. | |
| 6,116,354 | A | | 9/2000 | Buytaert | |

FOREIGN PATENT DOCUMENTS

| | | | | | |
|---|---|---|---|---|---|
| GB | 2 177 738 | A | | 1/1987 | |
| GB | 2 183 272 | A | | 6/1987 | |
| GB | 2 183 694 | A | | 6/1987 | |
| GB | 2 246 151 | A | | 1/1992 | |
| GB | 2 257 182 | A | | 1/1993 | |
| GB | 2 259 316 | A | | 3/1993 | |
| GB | 2285651 | A | | 7/1995 | |
| GB | 2 289 907 | A | | 12/1995 | |
| GB | 2 289 908 | A | | 12/1995 | |
| GB | 2 289 909 | A | | 12/1995 | |
| GB | 2 290 097 | A | | 12/1995 | |
| GB | 2 290 356 | A | | 12/1995 | |
| GB | WO96/35859 | | * | 5/1996 | E21B/47/022 |
| GB | 2 298 215 | A | | 8/1996 | |
| GB | 2 298 216 | A | | 8/1996 | |
| GB | 2 298 217 | A | | 8/1996 | |
| GB | 2 298 218 | A | | 8/1996 | |
| GB | 2 301 386 | A | | 12/1996 | |
| GB | 2 304 756 | A | | 3/1997 | |
| GB | 2 306 529 | A | | 7/1997 | |
| GB | 2 312 905 | A | | 11/1997 | |
| GB | 2 322 651 | A | | 9/1998 | |
| GB | 2 325 016 | A | | 11/1998 | |
| GB | 2 328 466 | A | | 2/1999 | |
| GB | 2 335 450 | A | | 9/1999 | |
| GB | 2 336 171 | A | | 10/1999 | |
| GB | 2 339 223 | A | | 1/2000 | |
| GB | 2 340 153 | A | | 2/2000 | |
| GB | 2 342 935 | A | | 4/2000 | |
| GB | 2 343 470 | A | | 5/2000 | |
| GB | 2 344 607 | A | | 6/2000 | |
| GB | 2 347 951 | A | | 9/2000 | |
| WO | WO 96/31679 | A1 | | 10/1996 | |
| WO | WO 01/34935 | A1 | | 5/2001 | |

* cited by examiner 22
11
21
19
17
16
15
10
14
13
13
12

CONTROL METHOD FOR USE WITH A STEERABLE DRILLING SYSTEM

This application claims benefit of provisional application No. 60/164,681 filed Nov. 10, 1999.

This invention relates to a method for use in controlling the operation of a steerable drilling system. The method is particularly suitable for use with a rotary steerable system, but may be used in other types of steerable drilling system used in the formation of subterranean wells.

One type of rotary steerable system comprises a downhole assembly including a drill bit. The drill bit is carried by a drill string which is rotated typically by a well head located drive arrangement. A bias unit is included in the downhole assembly, the bias unit including a plurality of hinged pads moveable between extended and retracted positions. The pads are moved hydraulically using drilling fluid under the control of a valve arrangement. The valve arrangement is designed to permit control over the pads such that, when desired, the pads can be moved to their extended positions in turn as the bias unit rotates. By appropriate control over the pads, the bias unit can be operated to apply a sideways load on the drill bit which in turn will cause the formation of a curve in the well bore being drilled. The orientation of the curve will depend upon how the bias unit is controlled.

It has been found that a number of factors must be taken into account when controlling the operation of a rotary steerable system. For example, the rate of change of direction of the bore hole being formed in response to the application of a given command signal to the bias unit depends upon several factors associated with the drilling system, for example rotary speed, weight on bit, rate of penetration and several factors associated with the formation being drilled, for example the dip and azimuth of bedding planes. As a consequence, it is common for well bores drilled using steerable drilling systems to deviate from their desired paths. Such well bores may be of tortuous form containing many dog legs. Depending upon the orientation of the curves formed in the well bore, water or gas may tend to collect in the curves. Such accumulation of water or gas may impair subsequent use of the well bore in the extraction of oil.

It is an object of the invention to provide a control method for use with a steerable drilling system, the method simplifying control of the drilling system.

According to the present invention there is provided a method of controlling the operation of a steerable drilling system comprising the steps of:

inputting parametric model data representative of drilling conditions;

inputting data representative of a desired drilling direction; and using the parametric model data and the data representative of the desired drilling direction in controlling the operation of the steerable drilling system.

The parametric model data is conveniently derived using data collected, in real time, during drilling. The parametric model data may include data representative of one or more of the following parameters: weight on bit, rotational speed, rate of penetration, torque, pressure, inclination, dip and azimuth of bedding planes or other formation characteristics, hole curvature/gauge or other geometric conditions, bit type and condition, and errors in instrumentation readings.

The use of such a system is advantageous in that compensation can be made for the operating conditions, thus the risk of supplying the drilling system with instructions to drill a curve of too tight or too small a radius of curvature or of too great or small a length in a given direction can be reduced, thus permitting the drilling of a well bore of less tortuous form.

The parametric model data and data representative of the desired drilling direction may be used directly in controlling the operation of the drilling system. Alternatively, an output signal may be produced which is used to control a display to provide an operator with information for use in controlling the operation of the drilling system. The display may be in a graphic form, for example in the form of a graph of build rate response against turn rate response upon which is plotted an envelope indicating the achievable responses for one or more sets of operating conditions.

With such a display, an operator will be able to see whether it is possible to steer the drill bit of the drilling system in a given direction under one or more sets of operating conditions. The operator may then be able to modify one or more of the operating conditions over which he has some control to ensure that the operating conditions under which the drilling system is operating are such as to permit steering of the drill bit in the desired direction.

Figure 2:
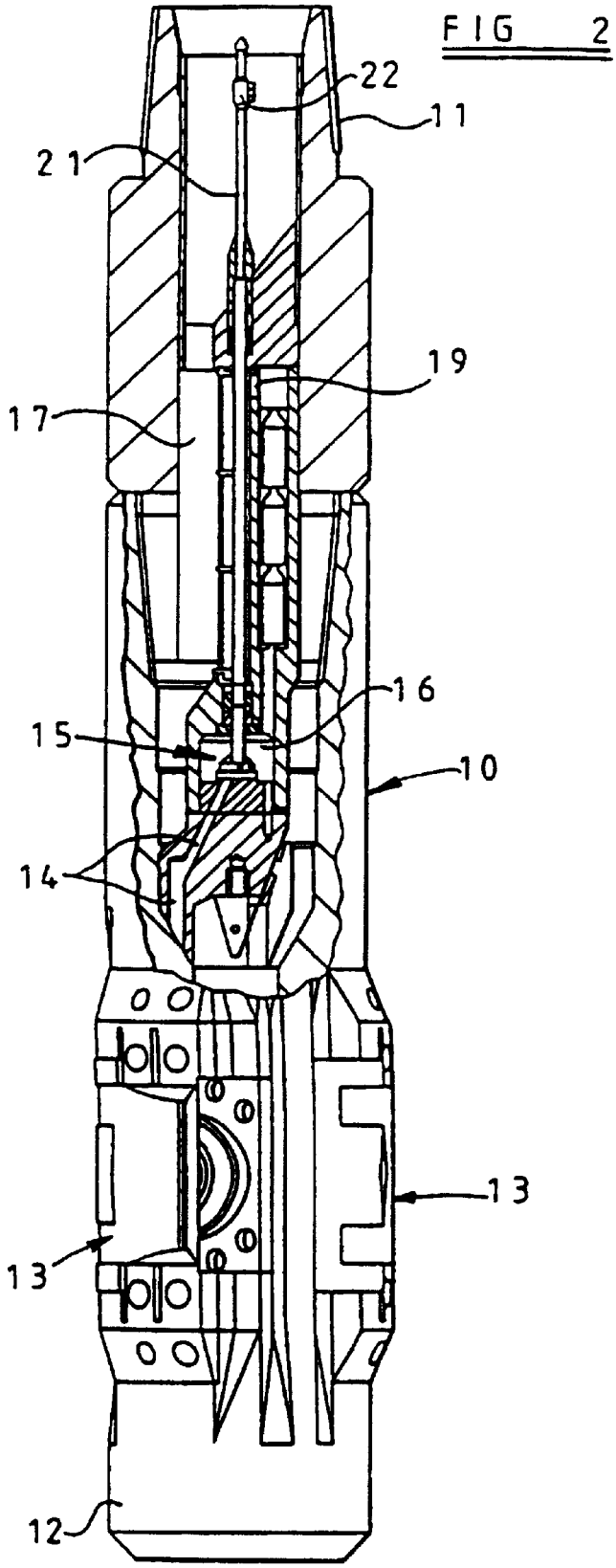
Figure 3:
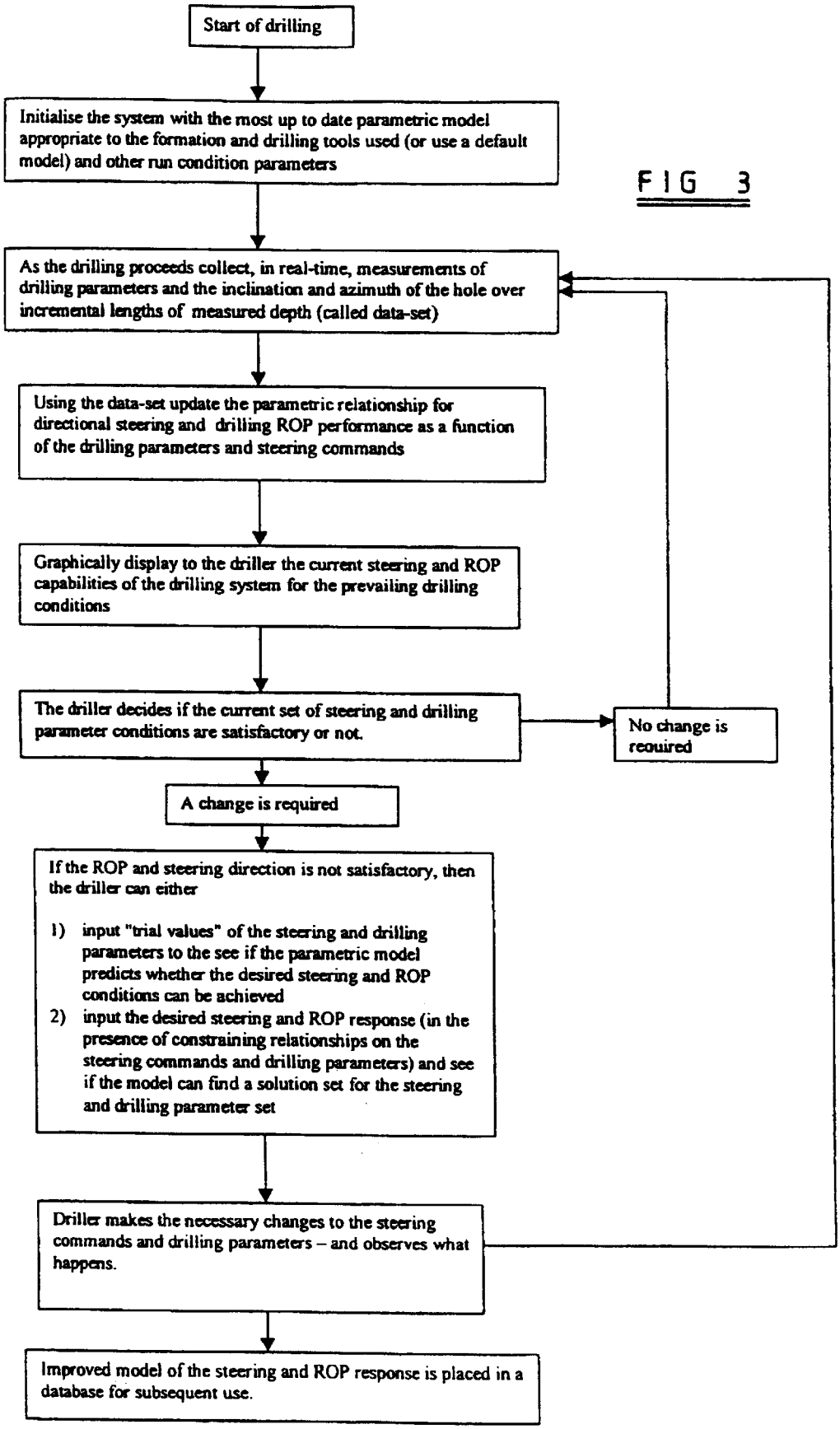
Figure 4:
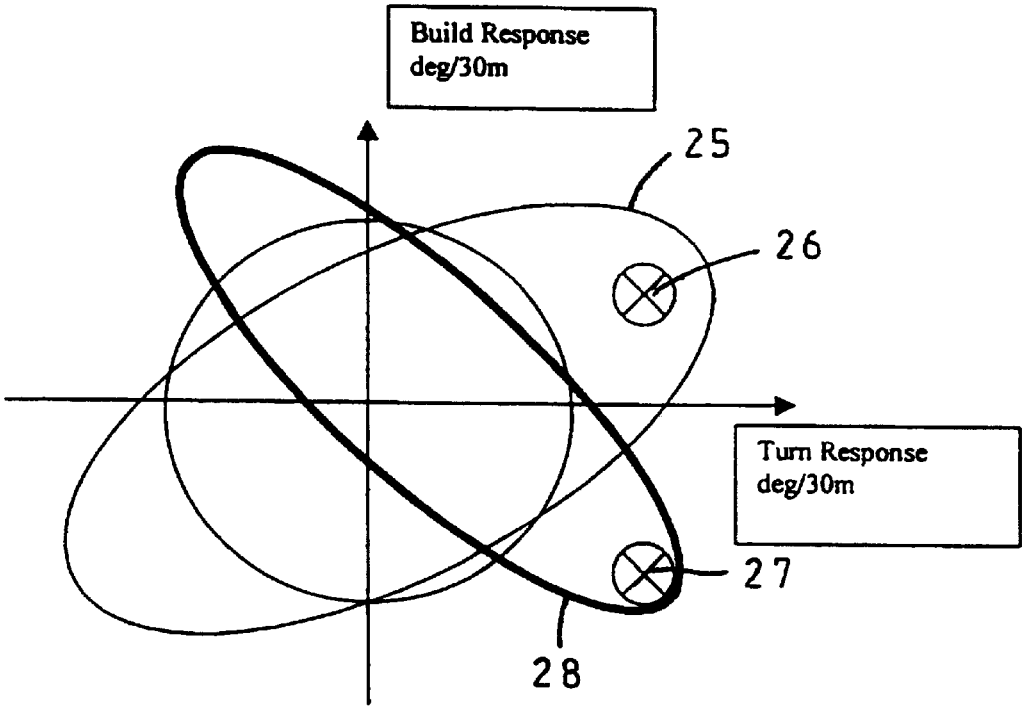

The invention will further be described, by way of example, with reference to the accompanying drawings, in which:

FIG. 1 is a diagram illustrating a drilling installation, with which the method of the invention may be used, FIG. 2 is a sectional view illustrating part of the downhole assembly of the installation of FIG. 1, FIG. 3 is a flowchart illustrating a method in accordance with an embodiment of the invention, and FIG. 4 is a representation of an output achieved using the method described with reference to FIG. 3.

FIG. 1 shows diagrammatically a typical rotary drilling installation of a kind in which the methods according to the present invention may be employed.

In the following description the terms "clockwise" and anti-clockwise" refer to the direction of rotation as viewed looking downhole.

As is well known, the bottom hole assembly includes a drill bit 1, and is connected to the lower end of a drill string 2 which is rotatably driven from the surface by a rotary table 3 on a drilling platform 4. The rotary table is driven by a drive motor, indicated diagrammatically at 5, and raising and lowering of the drill string, and application of weight-on-bit, is under the control of draw works, indicated diagrammatically at 6.

The bottom hole assembly includes a modulated bias unit 10 to which the drill bit 1 is connected and a roll stabilised control unit 9 which controls operation of the bias unit 10 in accordance with signals transmitted to the control unit from the surface. The bias unit 10 may be controlled to apply a lateral bias to the drill bit 1 in a desired direction so as to control the direction of drilling.

Referring to FIG. 2, the bias unit 10 comprises an elongate main body structure provided at its upper end with a threaded pin 11 for connecting the unit to a drill collar, incorporating the roll stabilised control unit 9, which is in turn connected to the lower end of the drill string. The lower end 12 of the body structure is formed with a socket to receive the threaded pin of the drill bit.

There are provided around the periphery of the bias unit, towards its lower end, three equally spaced hydraulic actuators 13. Each hydraulic actuator 13 is supplied with drilling fluid under pressure through a respective passage 14 under the control of a rotatable disc valve 15 located in a cavity 16 in the body structure of the bias unit. Drilling fluid delivered under pressure downwardly through the interior of the drill string, in the normal manner, passes into a central passage 17 in the upper part of the bias unit, through a filter, and through an inlet 19 to be delivered at an appropriate pressure to the cavity 16.

The disc valve 15 is controlled by an axial shaft 21 which is connected by a coupling 22 to the output shaft of the control unit, which can be roll stabilised.

The control unit, when roll stabilised (i.e. non-rotating in space) maintains the shaft 21 substantially stationary at a rotational orientation which is selected according to the direction in which the drill bit is to be steered. As the bias unit rotates around the stationary shaft 21 the disc valve 15 operates to deliver drilling fluid under pressure to the three hydraulic actuators 13 in succession. The hydraulic actuators are thus operated in succession as the bias unit rotates, each in the same rotational position so as to displace the bias unit laterally in a selected direction. The selected rotational position of the shaft 21 in space thus determines the direction in which the bias unit is actually displaced and hence the direction in which the drill bit is steered.

If the shaft 21 is not held in a substantially stationary position, then the actuators 13 are operated in turn but are not all operated in the same rotational position. As a result, rather than urging the bias unit laterally in a given direction, the direction in which the bias unit is urged changes continuously with the result that there is no net bias applied by the bias unit.

Drilling systems of the general type described hereinbefore are described in greater detail in EP 0520733, EP 0677640, EP 0530045, EP 0728908 and EP 0728909, the content of which is incorporated herein by reference.

As described hereinbefore, for a given biasing load applied by the bias unit, the rate of change of direction of the bore being formed is influenced by a number of factors. The factors influencing the vertical rate of change, the build rate, are not always the same as those influencing the rate of change in the horizontal direction, known as the turn rate.

FIG. 3 is a flowchart illustrating a method of controlling the operating of the drilling system of FIGS. 1 and 2. As shown in FIG. 3, at the start of drilling a control system used in controlling the position occupied by the shaft 21 is initialised with data representative of the likely drilling conditions. The input data is representative of factors associated with the drilling system, the formation being drilled, the direction of the well bore, and the shape of the well bore. The factors associated with the drilling system include the intended weight on bit, rate of penetration, rotational speed, torque, pressure and inclination of the drill bit. The factors associated with the formation being drilled include the dip and azimuth of bedding planes. Data representative of likely errors in sensor readings and representative of the type and condition of the drill bit may also be input. If no suitable data is available to be input, then a default data set may be used.

Whilst drilling is taking place, data representative of the actual drilling conditions is collected and transmitted to the control system. The readings are conveniently taken at intervals, for example at every 30 metres of measured depth. The measured data is used to update the data of the parametric model.

The updated data set of the parametric model is used to calculate a range of achievable drilling directions, and this information is displayed graphically to the operator of the drilling system, for example in the form of a chart as shown in FIG. 4. As shown in FIG. 4, the chart takes the form of a graph of build rate against turn rate upon which is plotted an envelope 25 illustrating the achievable drilling direction for the prevailing drilling conditions. Also plotted on the graph is the current drilling direction 26. The chart may also indicate a desired drilling direction 27 if this information has been input by the operator. Such a desired drilling direction 27 is indicated on FIG. 4.

Using the information displayed, the operator can determine whether or not it is possible to achieve the desired drilling direction 27 under the prevailing drilling conditions. This is a relatively simple task as, if the desired drilling direction 27 falls within the envelope 25, then it is achievable with the current drilling conditions, and drilling can continue with appropriate signals sent to the bias unit to urge the drill bit to drill in the desired direction.

If the desired drilling direction 27 falls outside of the envelope 25 of achievable directions (as shown in FIG. 4), then obviously if the well bore is to be drilled in the desired direction, this can only be achieved if the drilling conditions change. Although the operator has no control over a number of the drilling conditions, in particular the drilling conditions governed by the formation, he does have control over some of the drilling conditions associated with the operation of the drill bit. For example, the operator could modify the rate of penetration, weight-on-bit, or rotational speed of the drill bit. Prior to modifying the drilling conditions, the operator may input trial values of certain of the operating parameters into the control system. The control system is arranged to display the envelope 28 of achievable drilling directions for those operating conditions. If the trial values for the operating conditions result in the production of an envelope of achievable drilling directions including the desired drilling direction 27, then the operator may choose to use those drilling parameter values in the control of the drilling system and then to direct the drill bit in the desired direction. Alternatively, the control system may be set up in such a manner as to output suitable values for the drilling parameters in response to the operator entering a desired drilling direction.

A number of different algorithms may be used in the calculation of the envelope of achievable drilling directions.

In one simple technique, the response of the system to a given input is used to calculate gain values $K_B$ and $K_T$, cross-coupling values $C_{BT}$ and $C_{TB}$ and bias values $B_{bias}$ and $T_{bias}$ (where B and T represent Build and Turn respectively).

The build and turn values are then calculated by, for each factor influencing the responsiveness of the system to a steering command, calculating a normalised deviation of the parameter value from the mean value of that parameter and multiplying the deviation by a coefficient representative of the responsiveness of the system to that one of the factors, and adding the results for each factor to one another and to the relevant ones of the gain, cross-coupling and bias values. These calculations can be expressed by the following equations:

$$Build = W_{build} * \left[\frac{WOB - meanWOB}{meanWOB}\right] + R_{build} * \left[\frac{ROP - meanROP}{meanROP}\right] + P_{build} * \left[\frac{Pressure - meanPressure}{meanPressure}\right] + F_{build}\left[\frac{Flow - meanFlow}{meanFlow}\right] + M_{build} * \left[\frac{RPM - meanRPM}{meanRPM}\right] + T_{build} * \left[\frac{Torque - meanTorque}{meanTorque}\right] + I_{build} * \left[\frac{\sin Inc - mean\sin Inc}{mean\sin Inc}\right] + K_B * [BuildDemand\%] + C_{BT} * [TurnDemand\%] + build_{bias}$$

-continued $$Turn = W_{turn} * \left[\frac{WOB - meanWOB}{meanWOB}\right] + R_{turn} * \left[\frac{ROP - meanROP}{meanROP}\right] + P_{turn} * \left[\frac{Pressure - meanPressure}{meanPressure}\right] + F_{turn}\left[\frac{Flow - meanFlow}{meanFlow}\right] + M_{turn} * \left[\frac{RPM - meanRPM}{meanRPM}\right] + T_{turn} * \left[\frac{Torque - meanTorque}{meanTorque}\right] + I_{turn} * \left[\frac{\sin Inc - mean\sin Inc}{mean\sin Inc}\right] + K_T * [TurnDemand\%] + C_{TB} * [BuildDemand\%] + turn_{bias}$$

As mentioned above, other mathematical techniques may be used in the derivation of the envelopes of achievable steering directions.

Rather than use the method to determine which steering directions are acheivable for a given set of drilling conditions, or to determine sets of drilling conditions which can be used to acheive steering in a chosen direction, the method may be used to determine acheivable rates of penetration for a given set of drilling conditions. Such use of the method may have the advantage that the rate of penetration can be optimised.

Although the description hereinbefore related to the use of a specific type of steerable system, it will be appreciated that the invention is not restricted to the use of the method with the described drilling system and that the invention could be used with a range of other drilling systems.

What is claimed is:

1. A method of controlling the operation of a steerable drilling system comprising:

inputting parametric model data representative of drilling conditions;

calculating build and turn gain, cross-coupling and bias values using the parametric model data;

using the calculated build and turn gain, cross-coupling and bias values to derive build and turn responsiveness values;

using the derived build and turn responsiveness values in controlling the operation of a steerable drilling system;

wherein an output signal is produced which is used to control a display to provide an operator with information for use in controlling the operation of the drilling system and wherein the display is in graphic form of build rate response against turn rate response upon which is plotted an envelope indicating the achievable responses for one or more sets of operating conditions.

2. The method of claim 1 further comprising:

inputting data representative of a desired drilling direction;

and using the parametric model data and the data representative of the desired drilling direction in controlling the operation of the steerable drilling system.

3. The method of claim 2 wherein the parametric model data and the desired drilling direction data are used directly in controlling the drilling system.

4. The method of claim 1, wherein data collected during drilling is used to update the model.

5. The method of claim 1, wherein the model uses data representative of at least one of: weight on bit, rotational speed, rate of penetration, torque, pressure, inclination, dip and azimuth of bedding planes or other formation characteristics, hole curvature/gauge or other geometric conditions, bit type and condition, and errors in instrumentation readings.

6. A method of controlling the operation of a steerable drilling system comprising the steps of:

inputting parametric model data representative of drilling conditions;

calculating build and turn gain, cross-coupling and bias values using the parametric model data;

using the calculated build and turn gain, cross-coupling and bias values to derive build and turn responsiveness values;

using the derived build and turn responsiveness values to calculate a range of achievable drilling directions.

7. The method of claim 6 wherein the drilling conditions are selected from the group consisting of weight on bit, rate of penetration, rotational speed, torque, pressure, inclination of the drill bit, dip and azimuth of bedding planes or other formation characteristics, hole curvature/gauge or other geometric conditions, bit type and condition, and errors in instrumentation readings.

8. The method of claim 6, further comprising outputting the calculated range in a graphic form.

9. The method of claim 6, further comprising inputting a desired drilling direction, and using the derived build and turn responsiveness values in determining whether drilling in the desired drilling direction is achievable.

10. A method of controlling the operation of a steerable drilling system comprising:

inputting parametric model data representative of drilling conditions;

inputting data representative of a desired drilling direction;

calculating build and turn gain, cross-coupling and bias values using the parametric model data;

using the parametric model data and the data representative of the desired drilling direction to produce an output signal; and using the output signal to control a display to provide an operator with information in a graphic form for use in controlling the operation of the drilling system, wherein the display is in the form of a graph of build rate response against turn rate response upon which is plotted an envelope indicating achievable responses for one or more sets of operating conditions.

11. The method of claim 10 wherein the drilling conditions are selected from the group consisting of weight on bit, rate of penetration, rotational speed, torque, pressure, inclination of the drill bit, dip and azimuth of bedding planes or other formation characteristics, hole curvature/gauge or other geometric conditions, bit type and condition, and errors in instrumentation readings.

* * * * *